US010330371B2

(12) United States Patent
Jung

(10) Patent No.: US 10,330,371 B2
(45) Date of Patent: Jun. 25, 2019

(54) REFRIGERATOR

(71) Applicant: LG ELECTRONICS INC., Seoul (KR)

(72) Inventor: Jaehun Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/397,932

(22) Filed: Jan. 4, 2017

(65) Prior Publication Data

US 2017/0191740 A1 Jul. 6, 2017

(30) Foreign Application Priority Data

Jan. 5, 2015 (KR) ..... 10-2016-0001286

(51) Int. Cl.

| | |
|---|---|
| ***F25D 23/04*** | (2006.01) |
| ***A47B 88/477*** | (2017.01) |
| ***A47B 88/437*** | (2017.01) |
| ***A47B 57/32*** | (2006.01) |
| ***F25D 11/00*** | (2006.01) |
| ***F25D 23/02*** | (2006.01) |
| ***F25D 25/02*** | (2006.01) |
| *F25D 23/06* | (2006.01) |
| *F25D 25/04* | (2006.01) |

(52) U.S. Cl.

CPC ..... *F25D 23/04* (2013.01); *A47B 57/32* (2013.01); *A47B 88/437* (2017.01); *A47B 88/477* (2017.01); *F25D 11/00* (2013.01); *F25D 23/025* (2013.01); *F25D 25/022* (2013.01); *A47B 2210/175* (2013.01); *F25D 23/067* (2013.01); *F25D 25/04* (2013.01); *F25D 2323/023* (2013.01)

(58) Field of Classification Search

CPC ..... F25D 23/04; F25D 23/025; F25D 25/022; F25D 11/00; A47B 88/477; A47B 88/437; A47B 57/32

USPC ..... 312/405.1, 291, 292, 408

See application file for complete search history.

(56) References Cited

U.S. PATENT DOCUMENTS 5,199,778 A * 4/1993 Aoki ..... A47B 57/32 108/147

8,052,236 B2 * 11/2011 Kim ..... F25D 23/04 312/321.5

(Continued)

FOREIGN PATENT DOCUMENTS

| | | |
|---|---|---|
| EP | 2410270 | 1/2012 |
| EP | 2594874 | 5/2013 |

OTHER PUBLICATIONS

Extended European Search Report in European Application No. 17150274.3, dated May 12, 2017, 9 pages (with English translation).

*Primary Examiner* — Daniel J Troy
*Assistant Examiner* — Timothy M Ayres
(74) *Attorney, Agent, or Firm* — Fish & Richardson P.C.

(57) ABSTRACT

A refrigerator may include a cabinet disposed at a storage compartment, a door configured to open and close the storage compartment, a basket configured to accommodate goods, a moving frame coupled to a lower part of the basket, the moving frame being configured to support the basket, and to move vertically at the door in an integrated manner with the basket, a rail disposed at the door, and a supporter disposed between the moving frame and the rail to support the moving frame with respect to the rail.

16 Claims, 10 Drawing Sheets

(56) References Cited

U.S. PATENT DOCUMENTS

| | | | | |
|---|---|---|---|---|
| 8,123,314 | B2 * | 2/2012 | Becke | F25D 23/04 108/107 |
| 8,322,804 | B2 * | 12/2012 | Kim | F25D 23/04 312/321.5 |
| 9,518,776 | B2 * | 12/2016 | Baldo | F25D 25/02 |
| 2010/0109496 | A1 * | 5/2010 | Grasy | F25D 23/04 312/404 |
| 2012/0293056 | A1 * | 11/2012 | Kim | A47B 96/16 312/405.1 |
| 2013/0081421 | A1 | 4/2013 | Kwon et al. | |
| 2013/0119845 | A1 * | 5/2013 | Seo | F25D 23/025 312/404 |
| 2015/0211786 | A1 * | 7/2015 | Klitzing | F25D 25/025 29/890.035 |

* cited by examiner

REFRIGERATOR

CROSS-REFERENCE TO RELATED APPLICATION

This application claims the benefit of Korean Patent Application No. 10-2016-0001286, filed on Jan. 5, 2016, which is hereby incorporated by reference as if fully set forth herein.

FIELD

The present application relates to a refrigerator, and more particularly, to a refrigerator including a moving shelf or a moving basket.

BACKGROUND

In general, a refrigerator is an apparatus that discharges cool air generated by a refrigerating cycle involving a compressor, a condenser, an expansion valve, and an evaporator to lower the temperature in the refrigerator such that food is stored in a frozen state or in a refrigerated state.

A refrigerator generally includes a freezing compartment for storing food or beverages in a frozen state and a refrigerating compartment for storing food or beverages in a refrigerated state.

Refrigerators are classified into a top mount type refrigerator, in which a freezing compartment is disposed above a refrigerating compartment, a bottom freezer type refrigerator, in which a freezing compartment is disposed under a refrigerating compartment, or a side by side type refrigerator, in which a freezing compartment and a refrigerating compartment are disposed side by side. In each case, doors are provided at the freezing compartment and the refrigerating compartment, respectively, such that access to the freezing compartment and the refrigerating compartment is possible through the doors.

In addition to refrigerators in which a freezing compartment and a refrigerating compartment are partitioned from each other, there are also refrigerators in which access to a freezing compartment and a refrigerating compartment is possible through a single door. Most such single door type refrigerators are small-sized, and the freezing compartment is generally provided in a specific space inside the refrigerating compartment.

There are also French type refrigerators, in which an upper refrigerating compartment is opened and closed by left and right doors, as a kind of top mount type refrigerator. A freezing compartment of the French type refrigerator may also be opened and closed by left and right doors.

In recent years, a home bar, an ice maker, a shelf, and a basket have been frequently mounted at the rear of the door of the refrigerator in order to use the rear of the door as an additional storage space or an additional functional space. That is, the door has additional functions, such as the provision of additional storage space or the production and supply of ice or cold water, in addition to simply opening and closing the freezing compartment or the refrigerating compartment.

A refrigerator having a sub door for opening and closing a sub storage compartment provided in a main door has been proposed. This type of refrigerator may be called a door in door (DID) refrigerator. When the main door is opened, a main storage compartment is used, and when the sub door is opened while the main door is closed, the sub compartment may be used.

The sub storage compartment may be disposed at the rear side of the main door and may be a storage area partially separated by a partition from the main storage compartment. An area for the sub storage compartment is formed not at part of the main door but at substantially the entire main door.

Goods that are frequently used, such as beverages, may be stored in the sub storage compartment, and the sub storage compartment includes a plurality of shelves and a plurality of baskets. Since the height of goods vary, it may be necessary to change the positions of the shelves and the baskets as occasion demands.

SUMMARY

According to one aspect, a refrigerator may include a cabinet disposed at a storage compartment, a door configured to open and close the storage compartment, a basket configured to accommodate goods, a moving frame coupled to a lower part of the basket, the moving frame being configured to support the basket, and to move vertically at the door in an integrated manner with the basket, a rail disposed at the door, and a supporter disposed between the moving frame and the rail to support the moving frame with respect to the rail.

Implementations according to this aspect may include one or more of the following features. For example, the supporter may include a supporter frame including a plurality of rollers at upper and lower parts of the supporter, and the moving frame may include an extending frame coupled to the supporter frame. The basket is seated at an upper part of the moving frame, and the moving frame is configured to be inserted into a lower part of the basket such that the moving frame supports load applied to the basket. The basket may include insertion grooves which are configured to receive the extending frame. The insertion grooves are formed at both left and right sides of the basket. The supporter may include rollers disposed at upper and lower sides of the supporter, and the rail may include a roller guide configured to move the rollers vertically. The outer parts of the rollers include an elastic material, and rollers are configured to elastically deform based on the rollers moving along the roller guide, and elastically restore at the roller openings to be partially inserted into the roller openings.

The supporter may include a lever that is configured to be selectively inserted into the roller openings to limit the vertical movement of the moving frame. The supporter may include an operation unit that is configured to adjust displacement of the lever based on a user's input displacement. A spring may be disposed between the operation unit and the lever, the spring being configured to return the operation unit and the lever to an original position. An interlocking part is located between the operation unit and the lever, and the interlocking part, the operation unit, and the spring are each accommodated in a supporter cover. The door may include an outer door configured to define a front appearance of the door, a door dike configured to define a rear appearance of the door, and an inner space located between the outer door and the door dike, and the rail is embedded in the inner space and configured to couple to the door dike.

The door dike may include a cut-shaped rail mount unit that is configured to couple to the rail at the inner space. The rail and the rail mount unit are covered by a rail cover bracket disposed at the inner space. The rail cover bracket is coupled to the rail, wider than the rail and the rail coupling unit, and completely covers the rail and the rail coupling unit. When the inner space is filled with a filler, the rail cover bracket is disposed to separate the inner space into a first space for the filler and a second space for accommodating the rail and the rail coupling unit. The rail cover bracket may include a lattice rib at an outer surface of the rail cover bracket to increase a coupling area between the rail cover bracket and the filler. The door dike may include a rail coupling opening through which the supporter is configured to move forward and rearward along the rail to be coupled to the rail. The rail coupling opening is covered by a coupling cover after the supporter is coupled to the rail.

DETAILED DESCRIPTION

Figure 1:
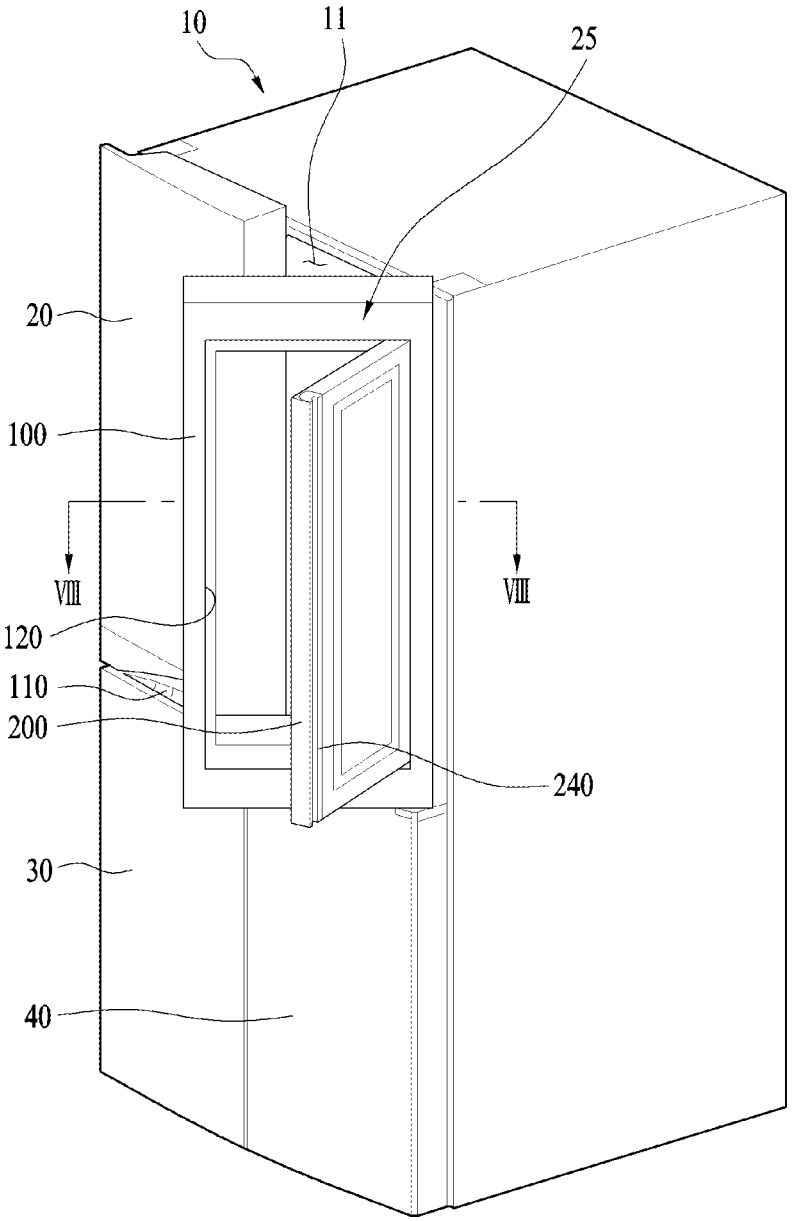
FIG. 1 is a view illustrating an example of a refrigerator.

As illustrated in FIG. 1, a refrigerating compartment is provided in the upper part of a cabinet 10 and a freezing compartment is provided in the lower part of the cabinet 10. The refrigerating compartment and the freezing compartment may be portions of a storage compartment or a main storage compartment 11 provided in the cabinet 10. The refrigerator may include any refrigerator with a door hinged to a cabinet for opening and closing a storage compartment of the refrigerator.

A left refrigerating compartment door 20 and a right refrigerating compartment door 25 are doors configured for opening and closing the refrigerating compartment, and are hinged to the left and right sides of the cabinet 10. In some examples, a single refrigerating compartment door may be hinged to the cabinet 10.

A left freezing compartment door 30 and a right freezing compartment door 40 may be respectively hinged to the left and right sides of the lower part of the cabinet 10 such that the left freezing compartment door and the right freezing compartment door are respectively provided under the left refrigerating compartment door and the right refrigerating compartment door. In some examples, a single freezing compartment door may be hinged to the cabinet, or may be a drawer type door, which is separably mounted in the cabinet in the forward-rearward direction.

A handle groove 32 may be provided at the top surface of the left freezing compartment door 30, and a handle groove may also be provided at the top surface of the right freezing compartment door 40.

As shown in FIG. 1, the right refrigerating compartment door 25 may include a main door 100 hingedly mounted to one side of the cabinet 10 and a sub door 200 hingedly mounted to the main door 100 or the cabinet 10. As provided, both the main door 100 and the sub door 200 may be opened to access the refrigerating compartment.

An opening 120 may be provided in the inner middle part of the main door 100, and a sub storage compartment or a door basket may be provided at the rear of the main door 100.

The sub door 200 may be opened to access the sub storage compartment through the opening 120 of the main door 100. That is, only the sub door 200 may be opened to access the sub storage compartment or the door basket without opening 120 the main door 100.

A groove-shaped handle 240 may be provided at the left side of a panel assembly of the sub door 200. The handle 240 may extend in the upward-downward direction, and may have a length equal to the height of the panel. The sub door 200 may be a left sub door provided at the left side of the cabinet 10. In this case, the handle 240 may be formed on the opposite side.

In addition, the rotational direction of the sub door 200 may be identical to that of the main door 100.

In the refrigerator, the sub door 200 may be formed to be smaller than the main door 100 while being inserted into the opening 120 of the main door 100 when the sub door 200 is closed. The refrigerator includes a moving basket mounted at the main door 100. A user may use the moving basket only when the sub door 200 is opened, and the moving basket may be used when the main door 100 is opened.

Figure 2:
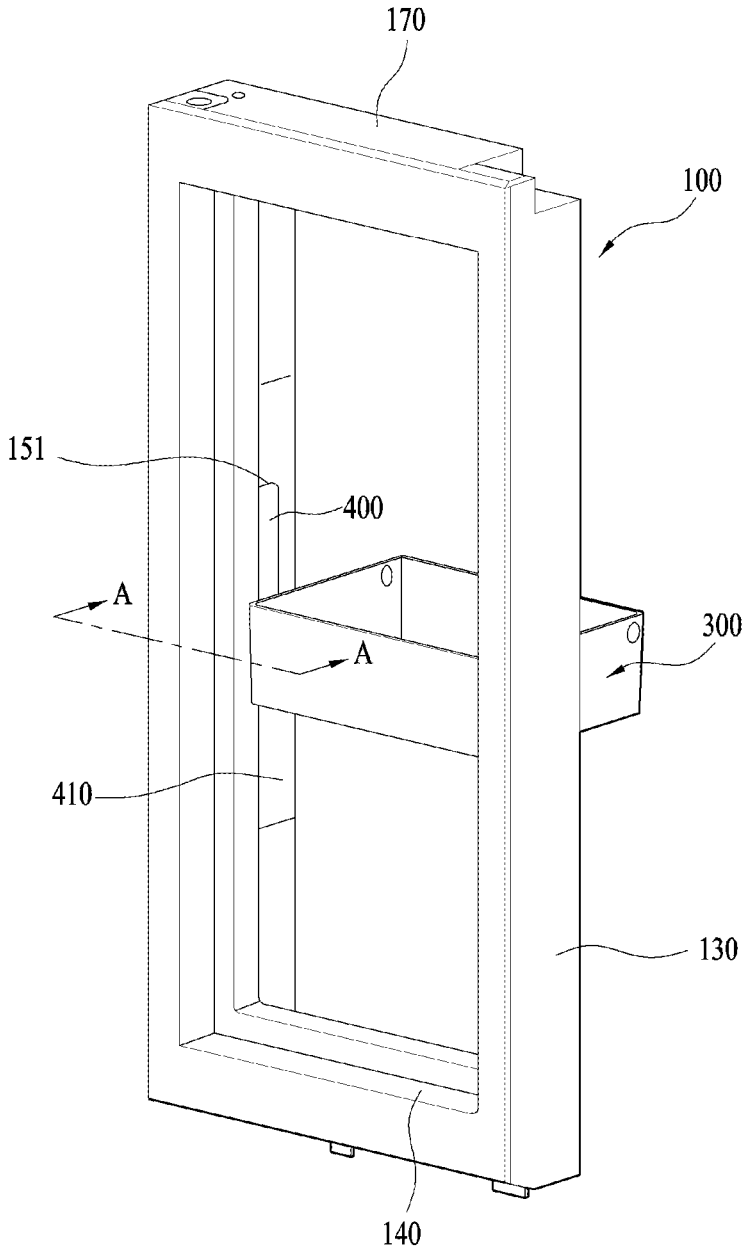
FIG. 2 is a view, as seen from the front of an example main door, illustrating the main door mounted with an example moving basket illustrated in FIG. 1.

As illustrated in FIG. 2, the main door 100 may include an outer door substantially forming an appearance of the main door 100. The outer door 130 may form a front surface and both side surfaces of the main door 100.

A door dike 150 may be provided at the rear of the outer door 130. The door dike 140 may form the rear surface of the main door 150.

In general, the door dike 140 may be formed of a plastic. A part of the door dike 140 may be formed to be inserted into a part of the storage compartment. The door dike 140 may be referred to as a door liner. A gasket may be mounted at the door dike 140. The gasket is coupled to the cabinet to seal the gap to prevent leakage of cool air.

Cap decoration parts 160 and 170 may be disposed at the main door 100. The cap decoration parts 160 and 170 may include an upper cap decoration part 170 for forming the upper surface of the main door 100 and a lower cap decoration part 160 for forming the lower surface of the main door 100.

The main door 100 may be formed by coupling the outer door 130 for forming the front surface and both side surfaces of the main door 100, the door dike for forming the rear surface of the main door 100, and the cap decoration parts 160 and 170 for forming the upper and lower surfaces of the main door 100 to one another. A space may be formed at an inner part of the above coupled configurations. The space is filled with a foaming agent.

The main door 100 may include a door frame 140. When the user opens the sub door of the door in door (DID) refrigerator, the door frame 140 may be provided to access the sub storage compartment or the door basket which are disposed at the rear side of the main door 100. The door frame 140 may be provided to form a hole at the front-central part of the main door 100.

The main door 100 may be formed by coupling the outer door 130, the door frame 140, the door dike 150, and the cap decoration parts 160 and 170 to one another. A space may be formed at an inner part of the above coupled configurations.

The moving basket 300 may be mounted at the door dike 150. In general, in order to reduce the weight of the door, the moving basket 300 may be formed to have a thin thickness and a plastic plate shape. Thus, it is difficult to support the moving basket 300 through the door dike 150. This is because, when a bracket supporting the basket is coupled to the door dike 150, the coupled part of the door dike may be damaged.

When a rail for guiding movement of the moving basket is mounted at the door dike 150, the rail may be visibly exposed as well as the door dike 150 may be damaged. In addition, the storage space may be reduced by the rail.

The rail 400 supporting the moving basket 300 may be disposed in the door dike 150. The door dike 150 may not include a separate protruding part. While the appearance of the door dike 150 is maintained, the rail 400 may be mounted at the door dike 150.

Figure 3:
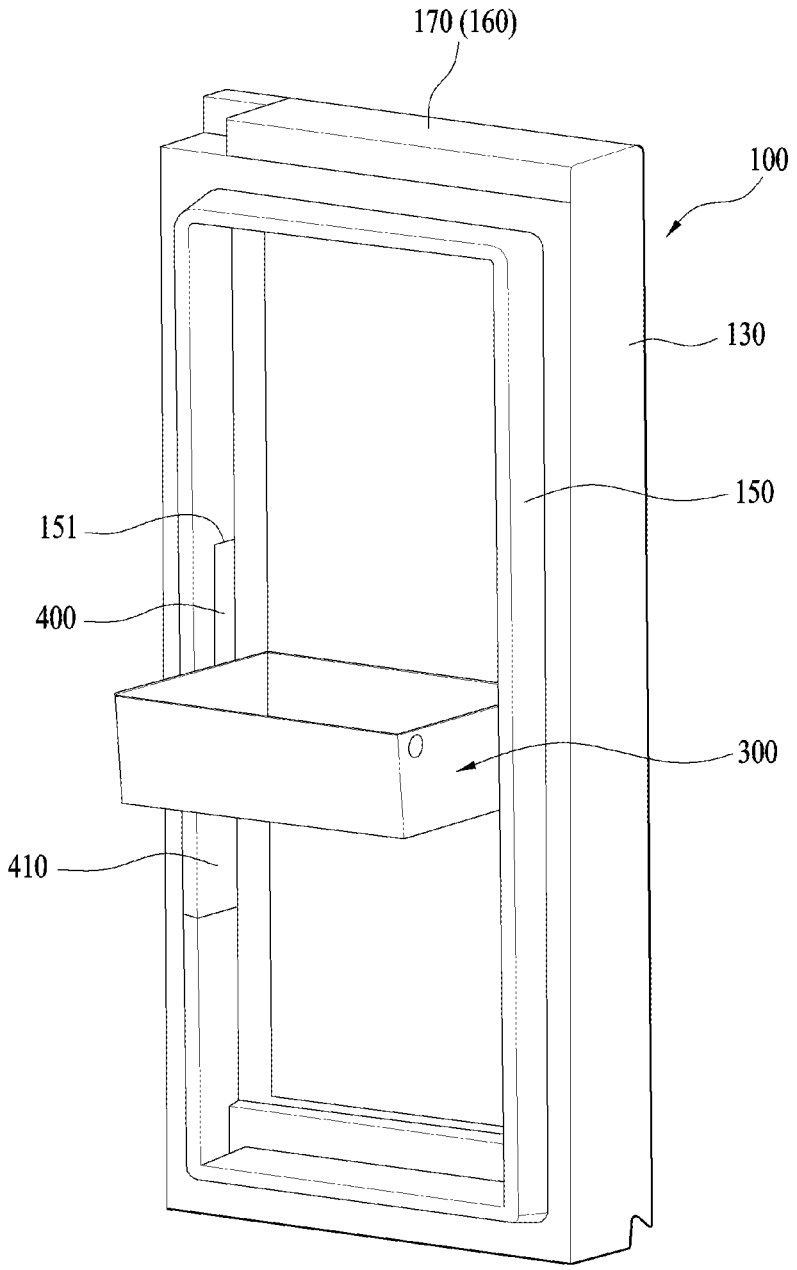
FIG. 3 is a view, as seen from the rear of the main door, illustrating the main door mounted with the moving basket illustrated in FIG. 1.

As illustrated in FIGS. 2 and 3, the moving basket 150 may move in the upward-downward direction through the embedded rail 400 in the door dike 150. In addition, since the rail 400 is embedded in the door dike 150, both sides of the moving basket 300 and both sides of the door dike 150 may be adjacent to each other. In addition, when the moving basket 300 is viewed from the front surface or the rear surface of the main door 100, the entire moving basket 300 may be shown without a covered part.

The structure or the shape of the rail 400 are embedded in the door dike 150, allowing a design to be provided and a reduction of the storage space may be eliminated. The user may easily use the moving basket 300 without regard to opening and closing of the main door 100.

The main door 300 may be formed by coupling the outer door 130, the door dike 150, and the cap decoration parts 160 and 170. In addition, the door frame 140 may be interposed between the outer door 130 and the door dike 150.

Rail mount units 151 may be formed at both sides of the door dike 150, and the rail 400 may be mounted at the rail mount units 151. The rail 400 may movably support the moving basket 300 in the upward-downward direction. Thus, the rail 400 may be formed to extend in the upward-downward direction.

As described above, an inner space is formed by coupling the outer door 130 for forming the front appearance of the door and the door dike 150 for forming the rear appearance of the door to each other. The inner space may be filled with a filler for insulation.

Thus, the rail 400 and a rail cover bracket 500 may be disposed at the inner space. The rail 400 and the rail cover bracket 500 may be embedded in the inner space to be mounted at the door dike 150. That is, the rail 400 may be embedded in the door dike 150 i.e. the inner space to support the moving basket 300.

Figure 4:
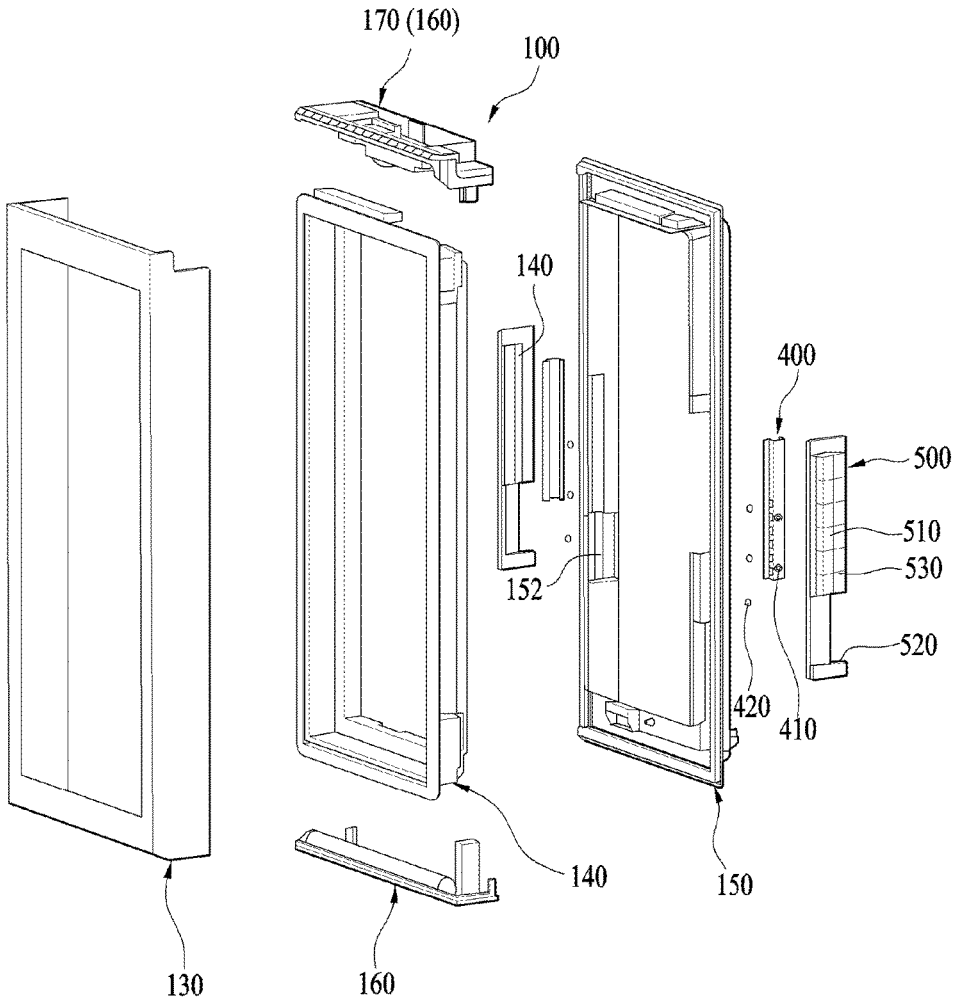
FIG. 4 is an exploded view illustrating the main door illustrated in FIG. 2.

As illustrated in FIG. 4, the cut-shaped rail mount units 151 may be formed at the door dike 150. In addition, the rail may be mounted at the rail mount units 151 at the inner space. Accordingly, the entire rail 400 is substantially disposed in the door dike 150, i.e. the space between the outer door 130 and the door dike 150, namely, the inner space of the door. Thus, the rail 400 does not protrude from the door dike 150.

The rail cover bracket 500 may be mounted at the one side of the rail mount units. The rail cover bracket 500 may cover the side of the rail 400. The rail cover bracket 500 may be disposed in the main door 100 to cover the rail 400.

The rail 400 may be formed to have a channel shape. In addition, a rail seating part 540 for seating the rail 400 may be formed at the rail cover bracket 500. Thus, the rail seating part 540 may be formed to extend in the upward-downward direction.

The rail 400 may be coupled to the rail cover bracket 500. The rail 400 may be coupled to the rail cover bracket 500 by a screw 420 which passes through a coupling hole 405 of the rail and a coupling hole 510 of the rail cover bracket 500.

The rail cover bracket 500 may be formed to be wider than the rail 400 and a rail coupling unit so as to cover the rail 400 and the rail mount units 151.

When the inner space is filled with the filler, the inner space for being filled with the filler may be isolated from the inner space for accommodating the rail and the rail coupling unit. That is, penetration of the filler to the rail 400 or the rail mount units 151 may be prevented during filling the filler.

The filling pressure of the filler may be high, which means that coupling strength between the rail cover bracket 500 and the door dike 150 is increased by the filler. The forces acting to the rail 400 through the moving basket is applied to the rail cover bracket 500 instead of the door dike 150. The rail cover bracket 500 is strongly coupled to the door dike 150 due to the filler. This allows the strength applied to the door dike 150 may be minimized.

A lattice rib 530 may be formed at the rail cover bracket 500 to increase a coupling area between the rail cover bracket 500 and the filler. The lattice rib 530 may be formed at the part toward the inner space which is filled with the filler. The lattice rib 530 may be formed at the outer surface of the rail cover bracket 500.

A rail coupling opening 152 may be formed at the door dike 150. The moving basket 300 is mounted at the rail 400 after the rail 400 is coupled to the door dike 150 in an integrated manner by foaming the filler.

The supporter may move in the forward-rearward direction to be inserted into the rail coupling opening 152, and the supporter may be inserted into the end of the rail to move in the upward-downward direction.

The ends of two rails may be disposed at the rail coupling opening 152. The supporter inserted through the end of an upper rail may move in the upward direction. The supporter inserted through the end of a lower rail may move in the downward direction. The end of one rail may be provided and a plurality of supporters may be inserted into the rail. Thus, a plurality of supporters as well as one support may be coupled to the rail through the rail coupling opening 152. A plurality of the moving baskets instead of one moving basket may be mounted through the rail coupling opening 152.

The rail coupling opening 152 may be covered by a coupling cover 410 after the moving basket 300 is coupled to the rail 400, as illustrated in FIGS. 1 and 2. This causes the opening 152 is not exposed to the user.

In addition, in order to separate the moving basket from the rail, the cover 410 may be separated, making it easy to mount and separate the moving basket 300.

Figure 5:
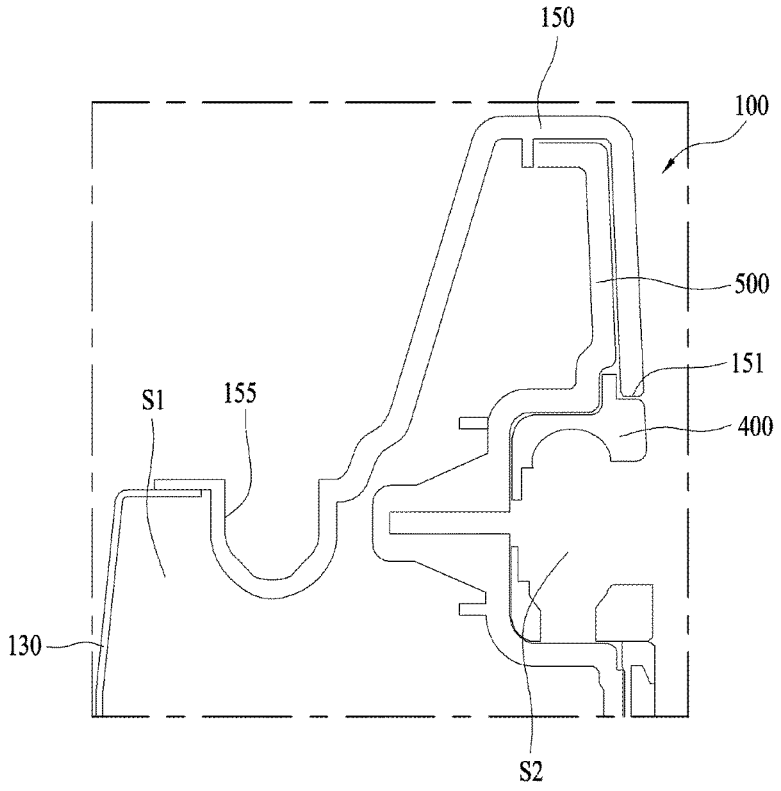
FIG. 5 is a cross-sectional view schematically illustrating an example coupling structure between an example door dike and an example rail.
Figure 6:
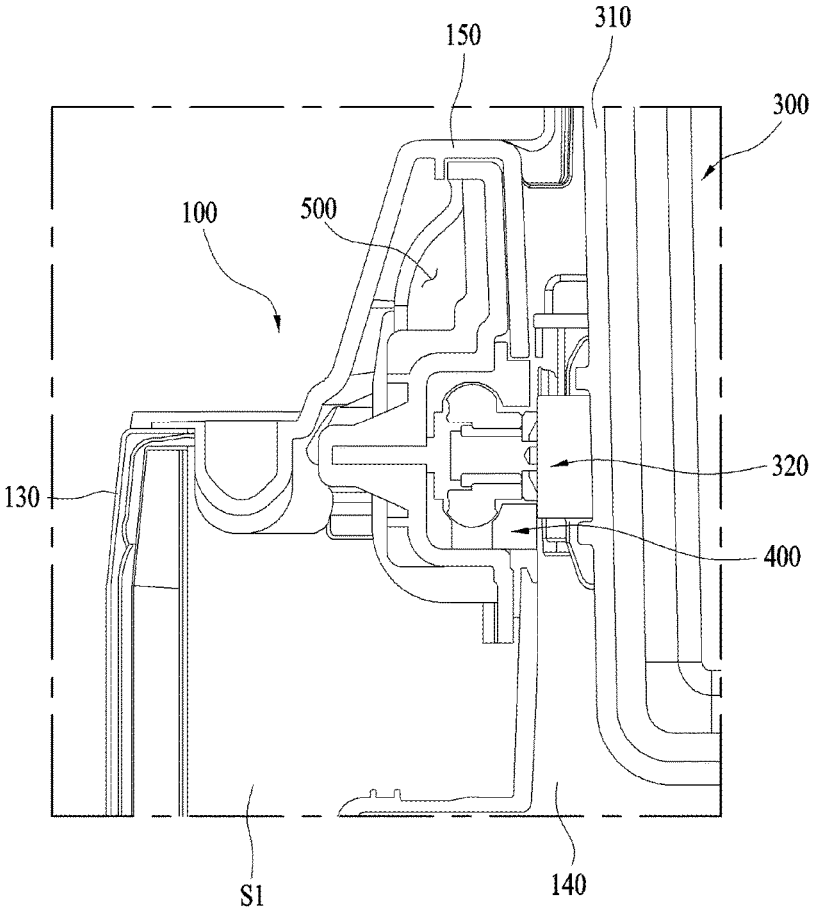
FIG. 6 is a cross-sectional view illustrating an example coupling structure of the door dike, the rail, and the moving basket.

As illustrated in FIG. 5, inner spaces S1 and S2 are formed in the door by coupling the outer door 130 and the door dike 150 to each other. These inner spaces may be filled with a foaming agent.

The rail mount units 151 may be formed at the door dike 150. The rail mount units 151 may be formed to insert the supporter 320, which will be described later. In addition, the rail 400 is mounted at the rail mount unit 151 through the inner spaces S1 and S2. The rail cover bracket 500 for covering the rail is provided in a direction of one side of the rail 400, i.e. the inner spaces. The rail cover bracket 500 may be provided to cover the entire rail.

The rail cover bracket 500 separates the inner spaces S1 and S2 from each other. The illustrated first inner space S1 is a space to be filled with the foaming agent. The second inner space S2 is not filled with the foaming agent. Thus, when the first inner space S1 is filled with the foaming agent, the rail cover bracket 500 may be strongly coupled to the door dike 150 in the door. In addition, since the rail cover bracket 500 substantially covers the entire rail 400, the rail 400 may sufficiently support load or impact transferred to the rail.

Each rail mount unit 151 may be formed at a protrusion of the door dike 150 inserted into the storage compartment. In addition, a gasket mount unit 155 may be formed at the door dike 150.

Figure 7:
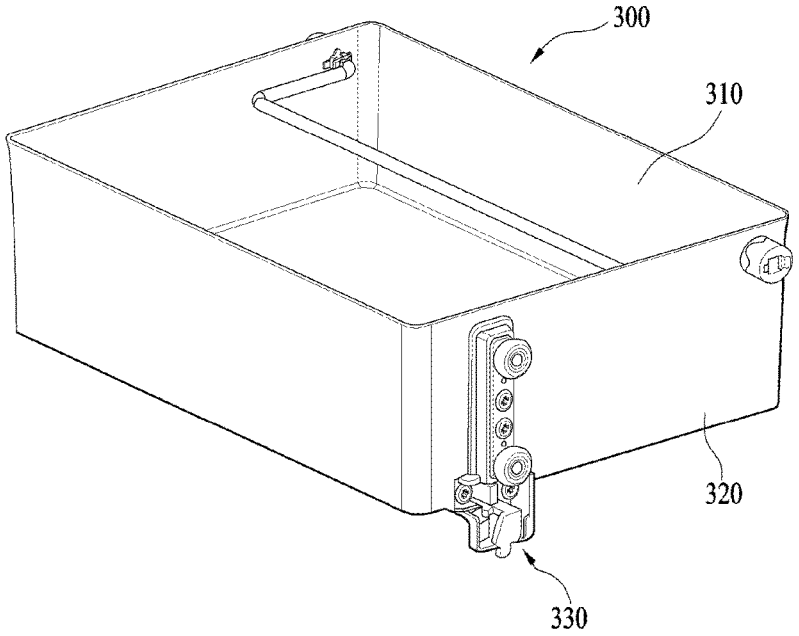
FIG. 7 is a view illustrating an example moving basket.

As illustrated in FIG. 7, the moving basket 300 may include a moving frame 320, and the moving basket 320 may include a basket 310 coupled to the moving frame 320. The moving basket 320 may move with the moving frame 320 in an integrated manner. In addition, the moving basket 300 may include the supporter 300 for supporting the moving basket 300 to the rail 400.

The supporter 300 may support the moving basket 300 and allow the moving basket 300 to move along the rail in the upward-downward direction.

Figure 8:
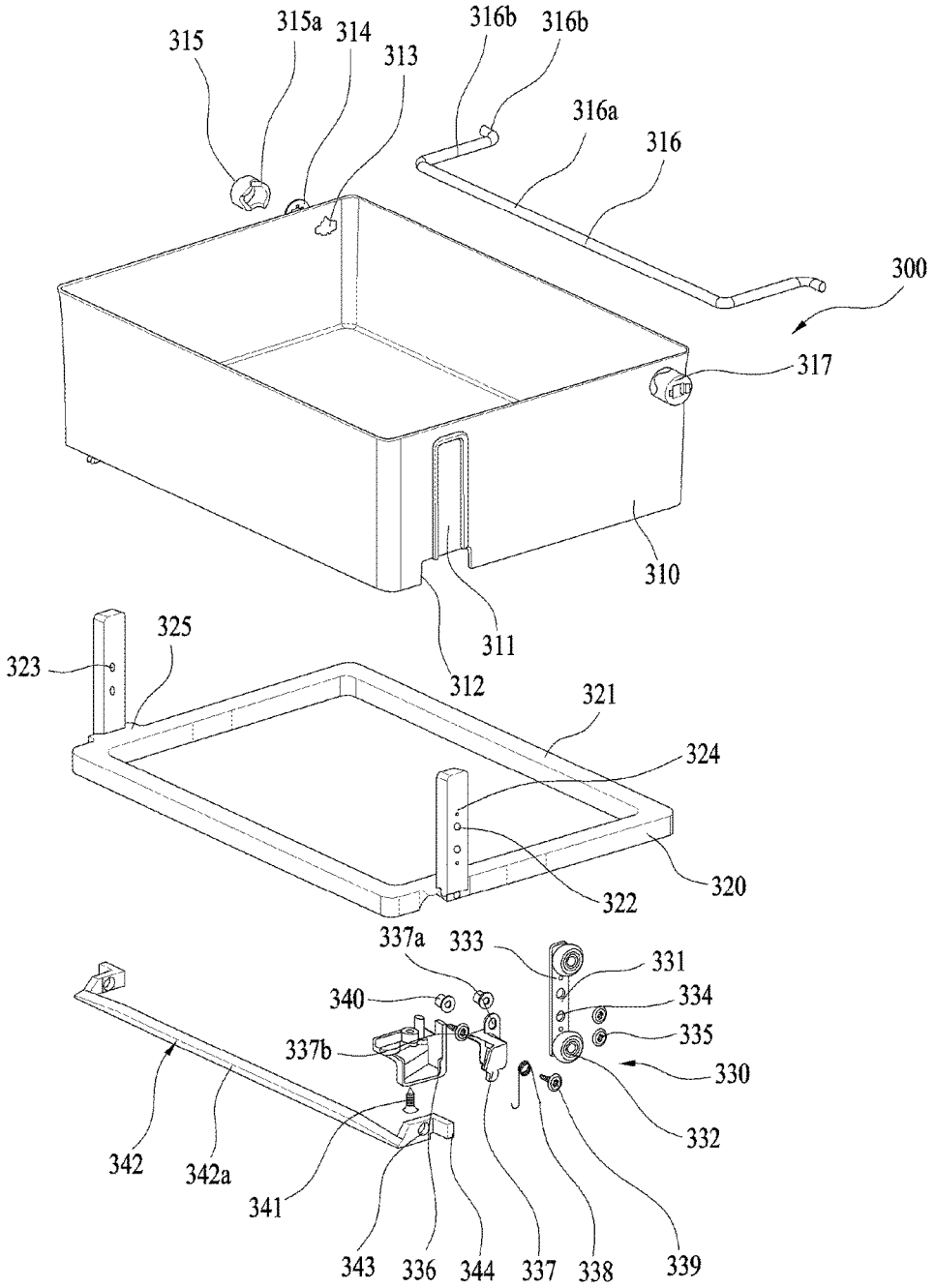
FIG. 8 is an exploded view illustrating the moving basket illustrated in FIG. 7.

As illustrated in FIG. 8, the moving frame 320 is a configuration for substantially supporting the load. Thus, the moving frame 320 may be provided to have a shelf shape, thereby constituting a moving shelf. In addition, the moving basket may be formed by coupling the basket 310 to the moving frame 320.

The moving frame 320 and the basket 310 may be separately formed to be coupled to each other. This is because the basket 310 formed of a plastic is vulnerable to bending load. As such, the moving frame 320 and the basket 310 may be separately formed such that the moving frame 320 may cope with the load or the bending load.

The moving frame 320 may be formed to have a square closed loop to evenly support the basket in every direction. Of course, the moving frame 320 may have high strength due to the above shape. Particularly, the moving frame 320 may be formed by aluminum die-casting thereby being strong.

The supporter 330 may include a supporter frame 331 having a plurality of rollers 332 disposed at upper and lower parts of the supporter frame 331. Furthermore, an extending frame 322 coupled to the supporter frame 331 may be formed at the moving frame 320. The rollers 322 may be configured to be inserted into the rail 400. In addition, the rollers 322 may be configured to easily move at the rail in the upward-downward direction.

A locating protrusion 324 and a coupling hole 323 may be formed at the extending frame 322. In addition, a groove 333, into which the locating protrusion 324 is inserted, and a coupling hole 334 corresponding to the coupling hole 323 may be formed at the supporter frame 311. A screw 335 may be provided to pass through the coupling holes 323 and 334. Thus, the supporter frame 331 may be strongly coupled to the moving frame 320 through the extending frame 322.

An insertion groove 311, into which the extending frame 322 is inserted, may be formed at the basket 310. In addition, an opening 312 for operating an operation unit, which will be described later, may be formed at the insertion groove 311.

Insertion grooves 311 may be formed at both left and right sides of the basket 310. A support point for supporting the basket may be formed at the sides of the basket instead of the front or rear ends of the basket.

A division bar 316 for dividing the inner spaces of the basket may be formed at the basket 310. The division bar 316 may be disposed in a horizontal direction in order to divide the inner spaces. If the division is not needed, the division bar 316 may be disposed in the basket in a vertical direction. In some examples, the division bar 316 may be rotatably mounted at the basket 310.

In detail, the division bar 316 may be formed to have a rod shape. The division bar 316 may include a horizontal rod 316*a* and vertical rods 316*b* disposed at both sides of the horizontal rod 316*a*. The division bar 316 may include mounting rods 316*c* extending from the ends of the vertical rods 316*b* outward. The mounting rods 316*c* are rotatably coupled to division bar supporters 315 that pass within through holes 313 formed at the basket. Washers 317 may be disposed between the division bar supporters 315 and the through holes 313.

A plurality of slots 315*a* may be formed at each of the division bar supporters 315. The vertical rods 316*b* may be inserted into the slots 315*a* to be fixed based on rotation of the mounting rods 316*c*. Since the slots 315*a* are formed in a circumferential direction, when each of the vertical rods 316*b* is inserted into a certain slot, the vertical rod 316*b* may be fixed at a certain angle. This means the angle of the horizontal rod 316*a* may be varied and then the horizontal rod 316*a* may be fixed.

The supporter 330 may include configurations for moving the moving basket in the upward-downward direction.

As illustrated in FIG. 8, the supporter 330 includes a lever 337. The lever 337 may function as a stopper for stopping the supporter 330.

The supporter 330 may include the operation unit 342 in which a user operates the movement of the moving basket 330. When the user operates the operation unit 342, displacement may occur at the operation unit. The displacement may be converted into displacement of the lever 337. The lever 337 and the operation unit 324 may be rotatably disposed at the moving frame 320.

In detail, the operation unit 324 includes a protrusion 344 disposed at the rear side of a rotation center 342. The rotation center 342 may be formed to have a hole shape to be coupled to a screw 339 through a bushing 340.

When a user presses a button 324*a* of the operation unit 324, the protrusion 344 generates rotational displacement. The rotational displacement is converted into rotational displacement of the lever 337.

The lever 337 may be coupled to the screw 339 through the bushing 340, and may be rotatably disposed at the moving frame 320.

As the protrusion 334 rotates to move in the downward direction, the lever 337 rotates about the rotation center 337*a*. That is, the protrusion 344 presses a protrusion 337*b* formed at the lever 337 to rotate the lever 337.

The moving basket may be fixed or move based on the rotation of the lever 337, which will be described later.

A spring 338 may be provided between the operation unit 324 and the lever 337. When a user operates the operation unit 324, the spring 338 is elastically deformed. The spring 338 is elastically restored when operation of the user is terminated. This is because displacement of the operation unit 324 generates displacement of the lever 337 and elastic deformation of the spring. The elastic restoration of the spring returns the operation unit and the lever to original positions thereof.

The operation unit 324 and the button 324*a* are disposed at the lower part of the moving frame 320. That is, the operation unit 324 and the button 324*a* do not protrude from the front or rear side of the moving frame 320 or the basket 310. The operation unit 324 and the button 324*a* may be formed to have a hidden type.

A rotation center 343 of the operation unit 324, a rotation center 337*a* of the lever 337, and a supporter cover 336 for accommodating the spring 337 may be provided. The supporter cover 336 may be fixed at the lower part of the moving frame 320 through a screw 341. Accordingly, configurations, in which displacement is generated, may be protected by the supporter cover 336. In addition, restrictions on the configurations, in which the displacement is generated, due to external interference may be prevented in advance.

Figure 9:
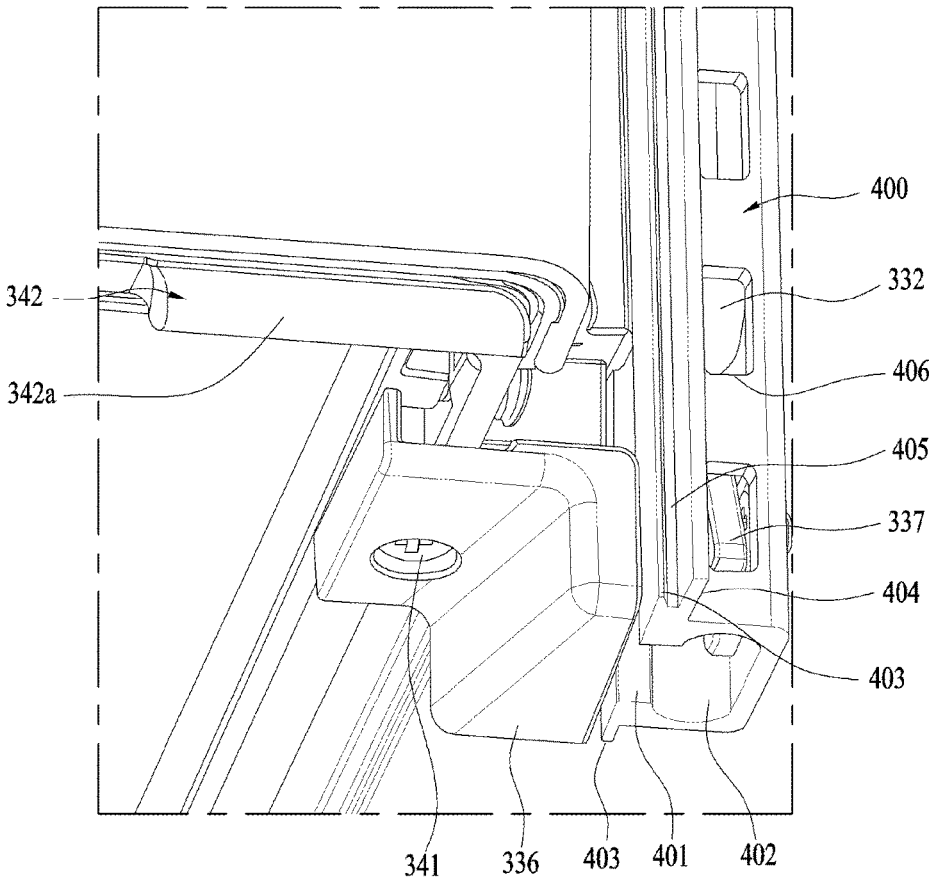
FIG. 9 is a bottom view illustrating the coupling structure of the moving basket and the rail illustrated in FIG. 7.
Figure 10:
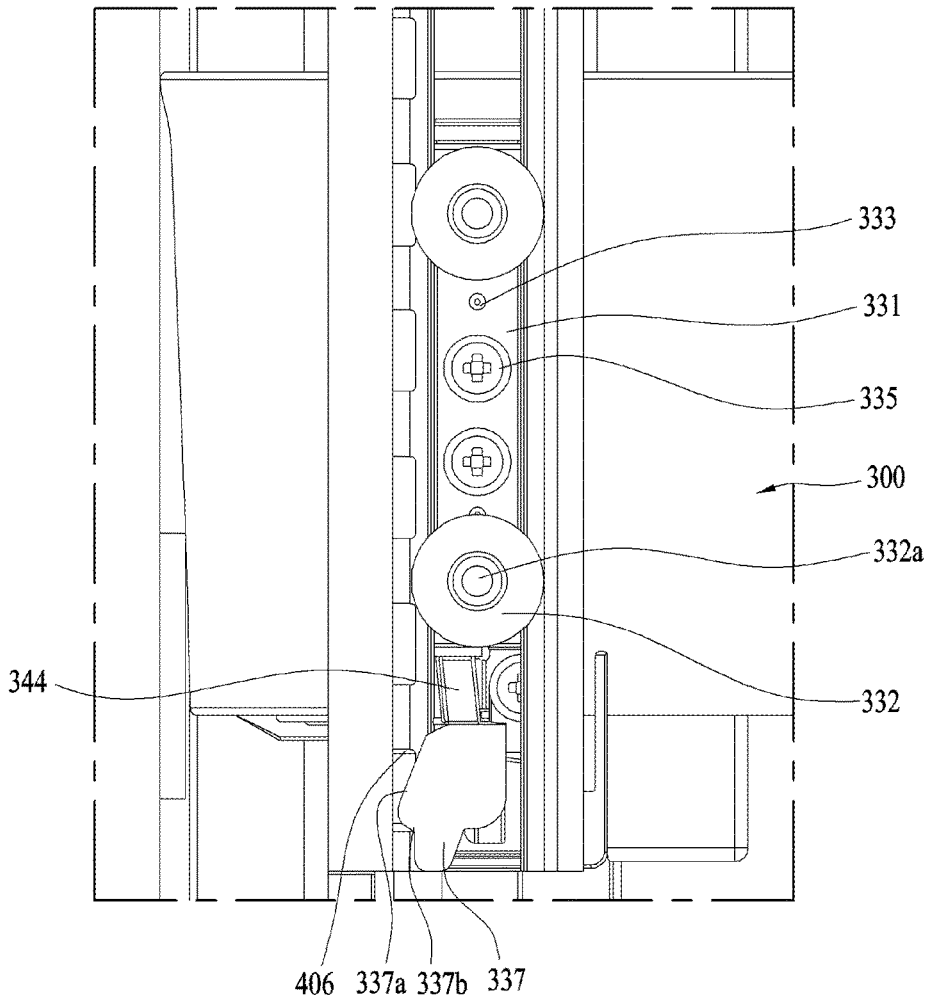
FIG. 10 is a cross-sectional side view illustrating an example coupling structure of the moving basket and the rail.

As described in FIGS. 9 and 10, a roller guide 402 may be long formed at the rail 400 in the upward-downward direction. The roller 332 may move up and down along the roller guide 402.

A plurality of roller openings 406 may be formed at one side of the roller guide 402. The roller openings 406 may be formed to be spaced away a certain distance from one another in the upward-downward direction.

The roller 332 is configured to be rolled about a roller rotation axis 332*a* as a rotation center. In addition, the outer part of the roller may be formed of an elastic material. For the example illustrated in FIG. 10, the roller 332 may be inserted into the roller openings 406. Thus, when the supporter 320 is fixed, the roller 332 may support bending load.

In addition, when the roller 332 is separated from the roller openings 406 to move in the upward-downward direction, the roller 332 may be elastically deformed. The roller 332 may be elastically restored when the roller 332 approaches the roller openings 406, and the roller 332 may be inserted into the roller openings 406, again.

As illustrated in FIGS. 9 and 10, the lever 337, in the same manner of the roller 332, may be movably disposed at the roller guide 402. When the lever 337 is inserted into the roller openings 406, the supporter 320 is fixed at the rail 400, and the moving basket 300 is fixed. In addition, when the lever 337 is separated from the roller openings 406, the moving basket 300 may move.

When a user presses a button 342*a* illustrated in FIG. 9, the protrusion 344 illustrated in FIG. 10 moves in the downward direction to rotate the lever 337. The lever 337 rotates in a counterclockwise direction to be separated from the roller opening 406.

When the user continues pressing the button 342*a*, the lever 337 is maintained in a separated state from the roller opening 406. Then, while the user presses the button 342*a*, the moving frame 302 may move up and down.

In addition, the lever 337 intends to continuously be restored by the spring. Accordingly, unless the user presses the button 342*a* at the neighborhood of a certain roller opening 406, the lever 337 is inserted into the certain roller opening 406. A position of the moving basket 300 may be fixed, again.

An inclined protrusion 337*a* and a step 337*a* may be provided at the lever 337 such that the lever 337 is easily inserted into or separated from the roller opening 406. The step 337*a* may be formed to support the lever 337 through the roller opening 406 and to limit an insertion length of the lever 337.

As illustrated in FIG. 9, a rail opening 401 may be formed at the rail 400. The rail opening 401 may be disposed to be substantially coplanar with the door dike 150. The supporter 320 may be inserted into the rail 400 by the rail opening 401.

Rail flanges 403 may be formed at both sides of the rail opening 401 to prevent damage of the rail opening 401. In addition, support flanges 404 may be formed at the rear side of the rail flanges 403. The support flanges 403 may be disposed to be contact with the inside of the door dike 150 at the inner space. As such, the coupling strength between the rail 400 and the door dike 150 may be improved.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator comprising:

a cabinet disposed at a storage compartment;

a door that is configured to open and close the storage compartment;

a basket that comprises a plastic material and that is configured to accommodate goods;

a moving frame that comprises a metallic material, that includes an extending frame, that is coupled to a lower part of the basket, that is configured to support the basket, and that is configured to move vertically at the door in conjunction with the basket;

a rail that includes a roller guide configured to vertically move an upper roller and a lower roller disposed at the door;

a supporter disposed between the moving frame and the rail that is configured to support the moving frame with respect to the rail, the supporter being coupled to the extending frame of the moving frame, and including the upper roller disposed at an upper side of the supporter, the lower roller disposed at a lower side of the supporter, and a lever configured to limit vertical movement of the moving frame, wherein the roller guide includes a plurality of roller openings vertically spaced apart from one another at one side of the roller guide, the lever and at least one of the upper roller and the lower roller being configured to be selectively inserted into the roller openings to support vertical load and bending load applied to the basket and the moving frame, wherein the upper roller and the lower roller each have outer parts formed of an elastic material, and wherein one side of the upper roller and one side of the lower roller is elastically deformed when the upper and lower rollers roll along the roller guide, and the lower roller is inserted into at least one of the roller openings when the lever is inserted into the roller openings to limit the vertical movement of the moving frame.

2. The refrigerator according to claim 1, wherein the basket is seated at an upper part of the moving frame, and the moving frame is configured to be inserted into a lower part of the basket such that the moving frame supports load applied to the basket.

3. The refrigerator according to claim 2, wherein the basket includes insertion grooves which are configured to receive the extending frame.

4. The refrigerator according to claim 3, wherein the insertion grooves are formed at both left and right sides of the basket.

5. The refrigerator according to claim 1, wherein the lever is disposed below the upper and lower rollers.

6. The refrigerator according to claim 5, wherein the supporter comprises an operation unit that is configured to adjust displacement of the lever based on a user's input displacement.

7. The refrigerator according to claim 6, further comprising a spring disposed between the operation unit and the lever, the spring being configured to return the operation unit and the lever to an original position.

8. The refrigerator according to claim 7, wherein an the interlocking part is located between the operation unit and the lever, and wherein the interlocking part, the operation unit, and the spring are each accommodated in a supporter cover.

9. The refrigerator according to claim 1, wherein the door comprises:

an outer door configured to define a front appearance of the door;

a door dike configured to define a rear appearance of the door; and an inner space located between the outer door and the door dike, and wherein the rail is embedded in the inner space and configured to couple to the door dike.

10. The refrigerator according to claim 9, wherein the door dike includes a cut-shaped rail mount unit that is configured to couple to the rail at the inner space.

11. The refrigerator according to claim 10, wherein the rail and the rail mount unit are covered by a rail cover bracket disposed at the inner space.

12. The refrigerator according to claim 11, wherein the rail cover bracket is coupled to the rail, wider than the rail and the rail coupling unit, and completely covers the rail and the rail coupling unit.

13. The refrigerator according to claim 12, wherein, when the inner space is filled with a filler, the rail cover bracket is disposed to separate the inner space into a first space for the filler and a second space for accommodating the rail and the rail coupling unit.

14. The refrigerator according to claim 13, wherein the rail cover bracket includes a lattice rib at an outer surface of the rail cover bracket to increase a coupling area between the rail cover bracket and the filler.

15. The refrigerator according to claim 9, wherein the door dike includes a rail coupling opening through which the supporter is configured to move forward and rearward along the rail to be coupled to the rail.

16. The refrigerator according to claim 15, wherein the rail coupling opening is covered by a coupling cover after the supporter is coupled to the rail.

* * * * *